United States Patent [19]

Webendorfer et al.

[11] Patent Number: 5,031,939

[45] Date of Patent: Jul. 16, 1991

[54] PRODUCT LABEL

[75] Inventors: Stephen D. Webendorfer, Miamisburg, Ohio; John M. Harden, Raleigh, N.C.

[73] Assignee: The Standard Register Company, Dayton, Ohio

[21] Appl. No.: 448,508

[22] Filed: Dec. 11, 1989

[51] Int. Cl.[5] ..... B42D 15/00

[52] U.S. Cl. ..... 283/81; 283/101; 283/79

[58] Field of Search ..... 283/79, 81, 98, 51, 283/100, 101

[56] References Cited

U.S. PATENT DOCUMENTS

| | | | |
|---|---|---|---|
| 3,993,814 | 11/1976 | Cavender | 283/81 |
| 4,028,824 | 6/1977 | Miller | 283/101 |
| 4,033,611 | 7/1977 | Johnsen | 283/101 |
| 4,110,502 | 8/1978 | Baer | 283/81 |
| 4,204,639 | 5/1980 | Barber et al. | 283/18 |
| 4,637,635 | 1/1987 | Levine | 283/81 |

FOREIGN PATENT DOCUMENTS

| | | | |
|---|---|---|---|
| 0111072 | 10/1928 | Austria | 283/79 |
| 2730231 | 1/1979 | Fed. Rep. of Germany | 283/79 |

*Primary Examiner*—Paul A. Bell

*Attorney, Agent, or Firm*—Killworth, Gottman, Hagan & Schaeff

[57] ABSTRACT

In a quantity of label-price tag composite forms, each composite form includes two shipping labels and a plurality of price tags associated with each of the shipping labels. The form includes a pair of shipping labels, each shipping label having a top edge, a bottom edge, and a pair of side edges. Each shipping label has one side edge abutting the other shipping label. Each of a pair of price tag sheets has a top edge, a bottom edge, and a pair of side edges. Each price tag sheet is secured at its top edge to the bottom edge of an associated shipping label. The width of each price sheet is less than the width of the shipping label associated therewith. A strip of discard material bridges the space between adjacent side edges of the pair of price tag sheets. The pair of price tag sheets are spaced apart such that the non-adjacent side edges thereof are inwardly of the non-abutting side edges of the pair of shipping labels. A layer of pressure sensitive adhesive is provided on the back side of the shipping labels, the price tag sheets, and the strip of discard material, and a sheet of release material is provided beneath the shipping labels, the price tag sheets, and the strip of discard material.

12 Claims, 4 Drawing Sheets

PRODUCT LABEL

BACKGROUND

The present invention relates to composite label structures and, more particularly, to a composite label which is useful as a shipping label and which includes a plurality of individual product labels.

Various items are shipped to retailers in cartons which are large enough to hold a number of such items. Not only does the shipping carton have to carry a label indicating its destination, but the individual items in the carton must be labeled as to price by the retailer after the carton is opened. A label system which facilitates both of these functions is shown in U.S. Pat. No. 4,110,502, issued Aug. 29, 1978, to Baer. Baer uses a computer carrier strip having a perforated feed which is slit longitudinally. A label price tag strip having a gummed back is adhered to the computer strip. The strips are perforated to form tear lines, and cutouts are made to form a composite strip form carrying T-shaped label-price tag sheets connected together by perforated tear lines only at the tops and bottoms of the labels. The price tag portions are separated by the cutouts and connected to the labels only by perforated tear or fold lines superimposed along the slits adjacent the computer strip. A computer prints both the shipping label and the price tags.

When a carton is to be shipped, the label for that carton is peeled from the backing strip and carries with it the price tag portion and the portion of the backing strip under the price tag portion. The price tag portion, with its backing strip portion, is folded back under the central portion of the label, leaving adhesive upper and lower portions which are pressed against the carton. This keeps the price tags clean and in good condition. When the carton reaches its destination and is opened, the user tears the label, with the price tags and backing strip portion from the carton, and removes the gummed price tags as needed.

Although providing a significant improvement, the Baer label construction was not readily usable with sheet fed non-impact printers, such as laser printers. To meet the need for a sheet fed laser printer label construction, the composite label arrangement of FIG. 1, was developed, as discussed in greater detail below. Although useful in such a system, this arrangement required significant removal of scrap material after printing and prior to application of a label to a carton.

It is seen, therefore, that there is a need for an improved label construction which requires a minimum of additional operations subsequent to printing.

SUMMARY OF THE INVENTION

This need is met by a quantity of label-price tag composite forms according to the present invention. Each such composite form includes two shipping labels and a plurality of price tags associated with each of the shipping labels. The composite form includes a pair of shipping labels, each shipping label having a top edge, a bottom edge, and a pair of side edges. The pair of shipping labels each has one side edge abutting. The composite form includes a pair of price tag sheets, each price tag sheet having a top edge, a bottom edge, and a pair of side edges. Each price tag sheet is secured at its top edge to the bottom edge of an associated shipping label. The width of each price sheet is less than the width of the shipping label associated therewith. The composite form further includes a strip of discard material bridging the space between adjacent side edges of the pair of price tag sheets. The pair of price tag sheets are spaced apart such that the non-adjacent side edges thereof are inwardly of the non-abutting side edges of the pair of shipping labels, and define peripheral edges of the composite form. The composite form includes a layer of pressure sensitive adhesive on the back side of the shipping labels, the price tag sheets, and the strip of discard material. Finally, the composite form includes a sheet of release material beneath the shipping labels, the price tag sheets, and the strip of discard material.

The sheet of release material defines score lines extending upward from the bottom edges of the shipping labels and across the backs of the shipping labels, such that when the release material above the score lines is removed, the price tag sheets may be folded under the shipping labels in a tucked position and the shipping labels held in place on a package surface by the exposed adhesive surrounding the price tag sheets.

The strip of discard material bridging the space between adjacent side edges of the pair of price tag sheets defines a score line about its periphery. The sheet of release material defines a score line therebeneath, whereby the strip of discard material and the portion of the sheet of release material therebeneath may be removed after printing on the shipping labels and the price tag sheets.

Each price tag sheet is secured at its top edge to the bottom edge of an associated shipping label along a perforated fold line.

Each of the price tag sheets includes a plurality of perforation lines which define a plurality of price tag labels.

The pair of shipping labels define perforation tear lines extending upward from the bottom edges of the shipping labels adjacent the side edges of the price tag sheets and across the fronts of the shipping labels adjacent the top edges of the shipping labels. The price tag sheets may be removed from a package surface by tearing along the perforation tear lines.

A label-price tag composite form includes two shipping labels and a plurality of price tags associated with each of the shipping labels. The composite form includes a pair of shipping labels, each shipping label having a top edge, a bottom edge, and a pair of side edges, the pair of shipping labels each having one side edge abutting. The composite form includes a pair of price tag sheets, each price tag sheet having a top edge, a bottom edge, and a pair of side edges. Each price tag sheet is secured at its top edge to the bottom edge of an associated shipping label. The width of each price sheet is less than the width of the shipping label associated therewith. A strip of discard material bridges the space between adjacent side edges of the pair of price tag sheets. The pair price tag sheets is spaced apart such that the non-adjacent side edges thereof are inwardly of the non-abutting side edges of the pair of shipping labels. A layer of pressure sensitive adhesive is provided on the back side of the shipping labels, the price tag sheets, and the strip of discard material. A sheet of release material is provided beneath the shipping labels, the price tag sheets, and the strip of discard material.

The sheet of release material defines score lines extending upward from the bottom edges of the shipping labels and across the backs of the shipping labels. When the release material above the score lines is removed, the price tag sheets may be folded under the shipping labels in a tucked position. The shipping labels are normally held in place on a package surface by the exposed adhesive surrounding the price tag sheets.

The strip of discard material bridging the space between adjacent side edges of the pair of price tag sheets defines a score line about its periphery. The sheet of release material defines a score line therebeneath, whereby the strip of discard material and the portion of the sheet of release material therebeneath may be removed after printing on the shipping labels and the price tag sheets.

Each price tag sheet is secured at its top edge to the bottom edge of an associated shipping label along a perforated fold line.

The pair of price tag sheets each include a plurality of perforation lines which define a plurality of price tag labels.

The pair of shipping labels define perforation tear lines extending upward from the bottom edges of the shipping labels adjacent the side edges of the price tag sheets and across the fronts of the shipping labels adjacent the top edges of the shipping labels, such that the price tag sheets may be removed from a package surface by tearing along the perforation tear lines.

Accordingly, it is an object of the present invention to provide an improved tuck label which is uniquely configured for use with a sheet fed non-impact printer; to provide such a tuck label in an easily handled composite form; and to provide such a tuck label in which the amount of form processing required subsequent to printing is minimized.

Other objects and advantages of the invention will be apparent from the following description, the accompanying drawings and the appended claims.

DETAILED DESCRIPTION OF THE PREFERRED EMBODIMENT

Figure 1:
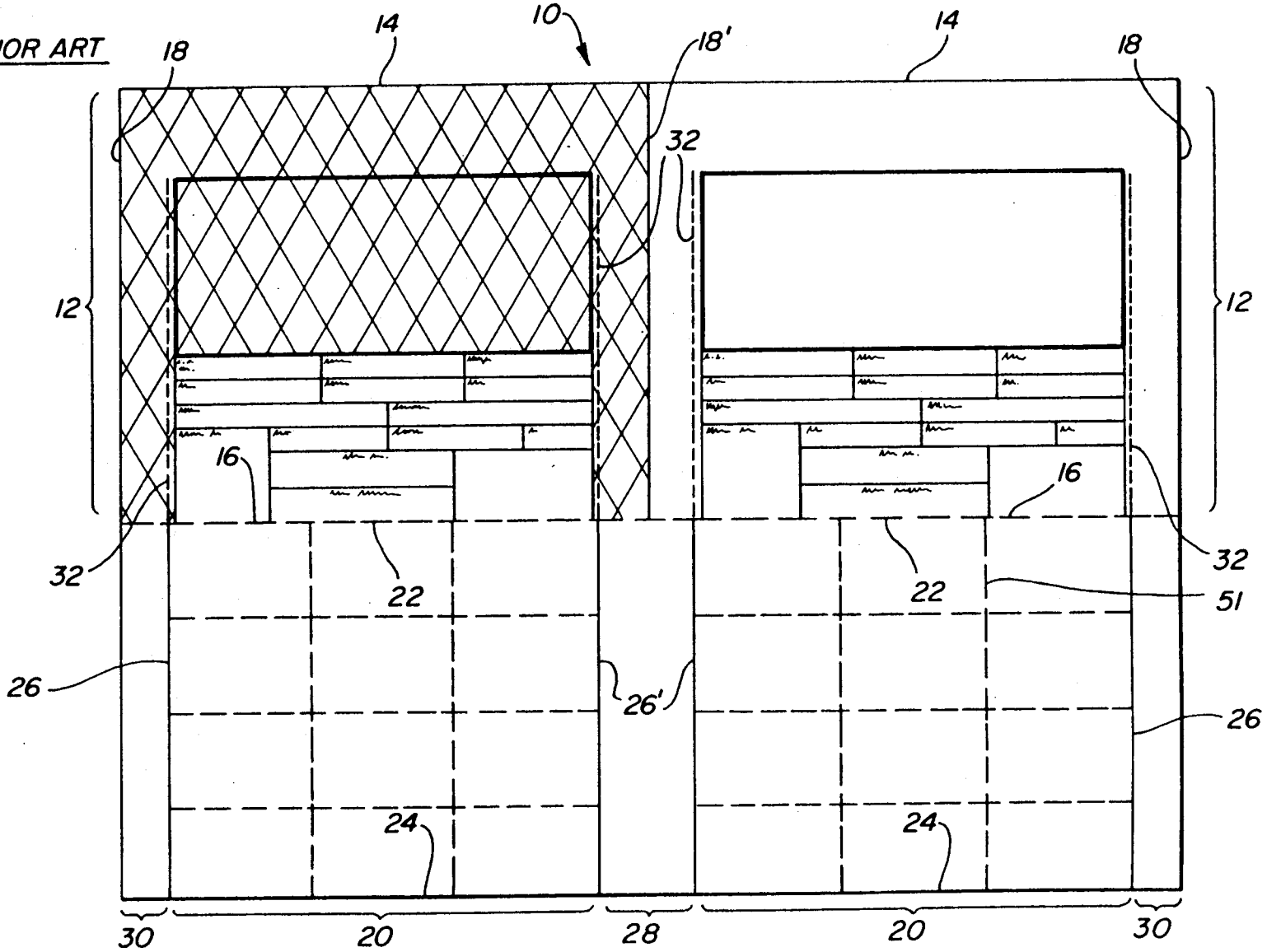
FIG-1 PRIOR ART
FIG. 1 is a plan view of the front side of a prior art composite shipping label-price tag form.
Figure 2:
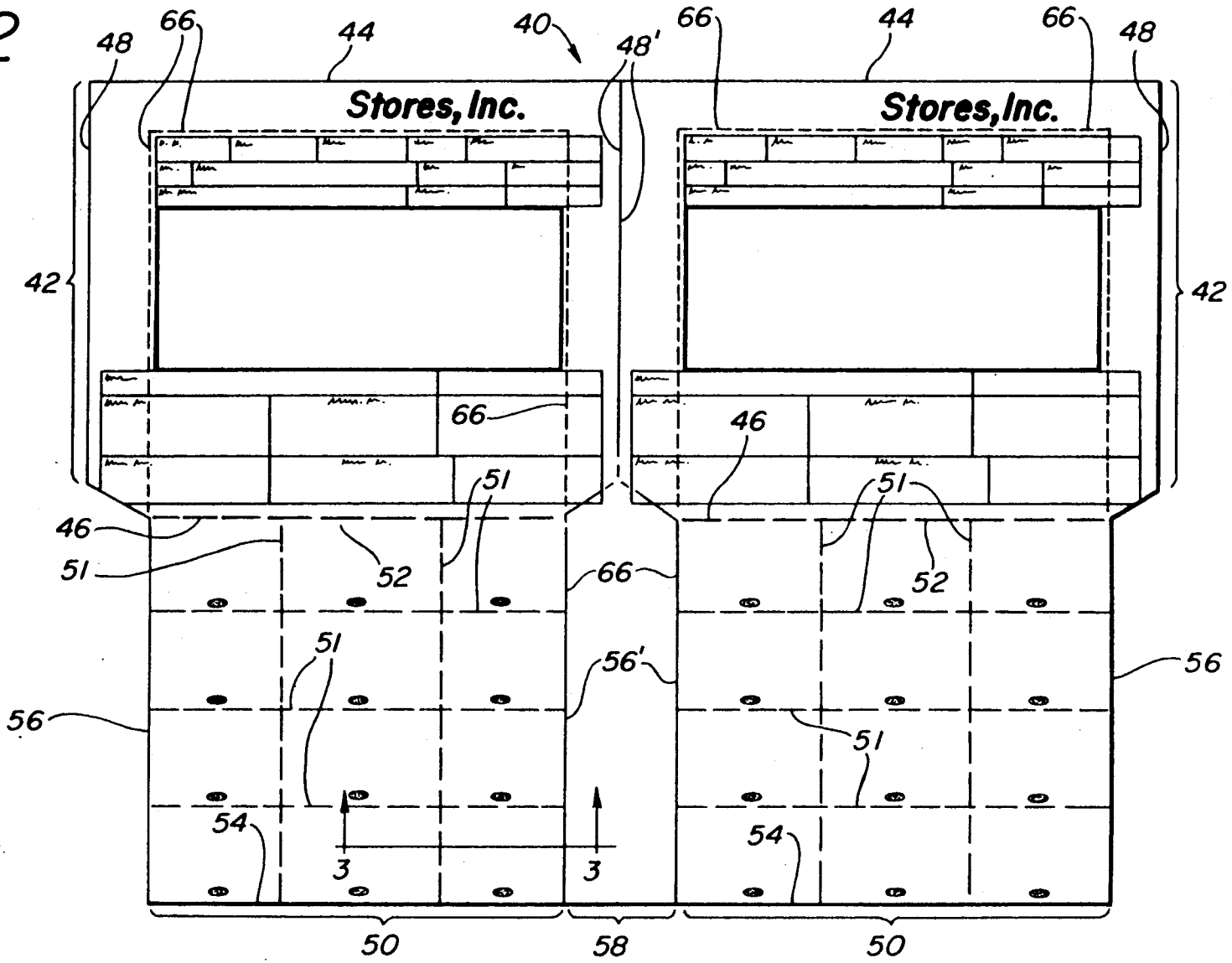
FIG. 2 is a plan view of the front side of a composite shipping label-price tag form according to the present invention.

The present invention relates generally to shipping labels and price tags, and more specifically, to a quantity of label-price tag composite forms, in which each such composite form includes two shipping labels and a plurality of price tags associated with each of the shipping labels. Composite forms have been utilized in the past to provide shipping information for a carton of items and to provide price tags for the items shipped in the carton. One such form 10, illustrated in FIG. 1, is particularly useful for sheet fed non-impact printing applications. The form 10 includes a pair of shipping labels 12. Each shipping label has a top edge 14, a bottom edge 16, and a pair of side edges 18 and 18'. The pair of shipping labels each have one side edge 18' abutting.

The composite form also includes a pair of price tag sheets 20. Each price tag sheet 20 has a top edge 22, a bottom edge 24, and a pair of side edges 26 and 26'. Each price tag sheet 20 is secured at its top edge 22 to the bottom edge 16 of an associated shipping label. The width of each price sheet 20 is less than the width of the shipping label 12 associated therewith. A strip of discard material 28 bridges the space between adjacent side edges 26' of the pair of price tag sheets 20. Additional strips of discard material 30 are positioned outwardly of the price tag sheets 20 such that the labels 12, price tag sheets 20, and strips 28 and 30 collectively define a rectangular form of the type that may conveniently be printed using a sheet fed non-impact printer.

A layer of pressure sensitive adhesive (not shown) on the back side of the shipping labels 12, the price tag sheets 20, and the strips of discard material 28 and 30 is covered by a sheet of release material (not shown) beneath the shipping labels 12, the price tag sheets 20, and the strips of discard material 28 and 30. After printing the labels, the strips 28 and 30 and associated adhesive and release material are removed.

The portion of the sheet of release material behind the area indicated by cross hatching in FIG. 1 is then removed. The cross hatching is shown only on one of the shipping labels 12 for purposes of clarity, but it will be appreciated that the release material behind both of the shipping labels in this area is removed. Since this removed release material was the only means securing the two shipping labels together, the labels are then separated. The price tag sheet 20 is folded under the label 12 and is secured in that position by the exposed pressure sensitive adhesive. The combination shipping label and price tag sheet is then applied to a shipping carton and held in position by means of the pressure sensitive adhesive that is exposed on the back side of the shipping label 12 adjacent edges 18, 18', and 14. When the shipping carton reaches its destination, the shipping label 12 is torn along perforation tear lines 32, exposing the individual price tags. The price tags may then be peeled from the sheet of release material and applied to the items in the carton.

The difficulty encountered with the form of FIG. 1 is that there is a significant amount of work required, after the printing operation and before the labels can be applied to the cartons, (to remove the discard material and portions of the sheet of release material). The present invention reduces these difficulties by providing a label-price tag composite form having less discard material requiring removal, and which can be printed by means of a sheet fed non-impact printer.

Reference is now made to FIGS. 2–5 which illustrate the shipping label-price tag composite form 40 of the present invention which is particularly useful for sheet fed non-impact printing applications. It will be appreciated that present invention also encompasses quantities of such forms. The form 40 includes a pair of shipping labels 42. Each shipping label has a top edge 44, a bottom edge 46, and a pair of side edges 48 and 48'. The pair of shipping labels each have one side edge 48' abutting.

The composite form also includes a pair of price tag sheets 50, each including a plurality of perforation lines 51 which define a plurality of price tag labels. Each price tag sheet 50 has a top edge 52, a bottom edge 54, and a pair of side edges 56 and 56', and is secured at its top edge 52 to the bottom edge 46 of an associated shipping label along a perforated fold line. The width of each price sheet 50 is less than the width of the shipping label 42 associated therewith. A strip of discard material 58 bridges the space between adjacent side edges 56' of the pair of price tag sheets 50. The pair of price tag sheets 50 are spaced apart such that the non-adjacent side edges 56 of the sheets 50 are positioned inwardly of the non-abutting side edges 48 of the pair of shipping labels 42, and define peripheral edges of the composite form. While this does not result in a perfectly rectangular form, it has been found that the composite form of the present invention is sufficiently rectangular so that it can be feed successfully through sheet fed non-impact printers, such as for example laser printers.

A layer of pressure sensitive adhesive 59 (FIG. 3) on the back side of the shipping labels 42, the price tag sheets 50, and the strip of discard material 58 is covered by a sheet of release material 60 beneath the shipping labels 42, the price tag sheets 50, and the strip of discard material 58. After printing the labels, the strip 58 and associated adhesive and release material are removed.

Figure 5:
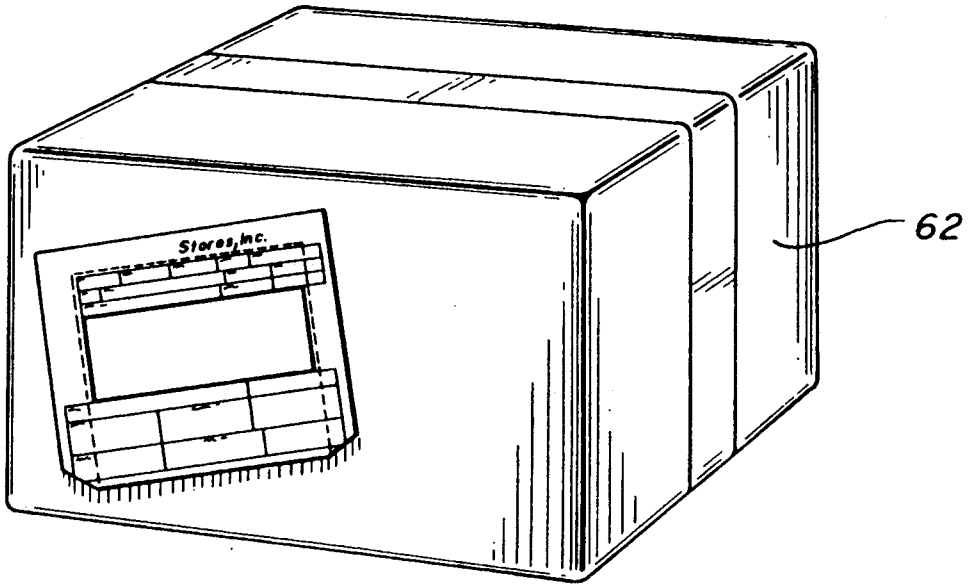
FIG. 5 is a perspective view of a shipping carton with a shipping label and associated price tags affixed thereto.
Figure 4:
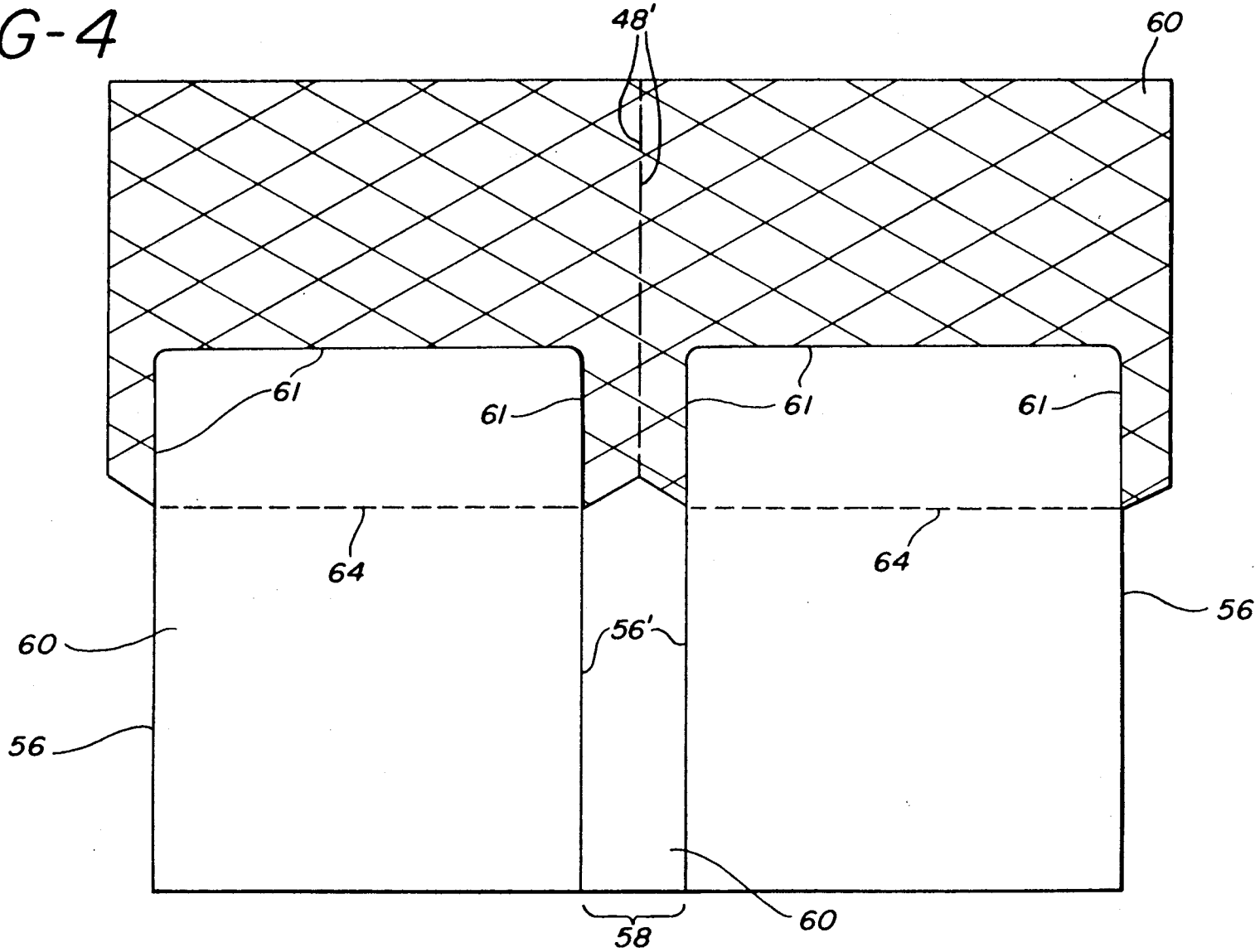
FIG. 4 is a plan view of the back side of the composite shipping label-price tag form of FIG. 2.

The portion of the sheet of release material 60 indicated by cross hatching in FIG. 4 is then removed. Toward this end, the sheet of release material 60 defines score lines 61 extending upward from the bottom edges of the shipping labels and across the backs of the shipping labels. When the release material above the score lines 61 is removed, the two shipping labels are separated. The price tag sheets 50 may be folded under the shipping labels 42 in a tucked position and the shipping labels held in place on a package surface 62 by the exposed adhesive surrounding the price tag sheets 50, as shown in FIG. 5. To facilitate folding the price tag sheet, the release material 60 may define perforation fold lines 64 aligned with the top edges 52 of the price tag sheets 50. The pair of shipping labels 42 define perforation tear lines 66 extending upward from the bottom edges of the shipping labels adjacent the side edges 56 and 56' of the price tag sheets and across the fronts of the shipping labels adjacent the top edges of the shipping labels 42. When the shipping carton reaches its destination, the shipping label 42 is torn along perforation tear lines 66, exposing the individual price tags. The price tags may then be peeled from the sheet of release material and applied to the items in the carton. Due to the fact that tear lines 66 extend across the fronts of the shipping labels at a point adjacent the lower edge 54 of the sheet 50 when sheet 50 is folded under label 42, tearing along line 66 results in permitting sheet 50 to be completely removed along with that portion of the label 42 within line 66.

Figure 3:
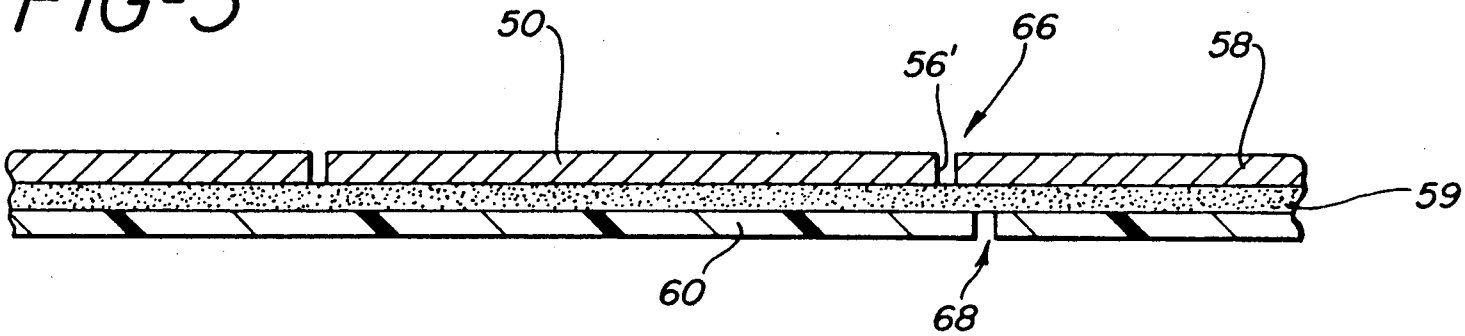
FIG. 3 is an enlarged, partial sectional view, taken generally along line 3—3 in FIG. 2.

As best shown in FIG. 3, the strip of discard material 58 bridging the space between adjacent side edges 56' of the pair of price tag sheets 50 defines a score line 66 about its periphery. Similarly, the sheet of release material 60 defines a score line 68 generally beneath score line 66. The strip of discard material 58 and the portion of the sheet of release material 60 therebeneath may be removed quite easily after printing on the shipping labels and the price tag sheets is completed. Score lines 66 and 68 are slightly offset such that adhesive 59 in the overlapping region maintains sufficient structural integrity to hold strip 58 in position.

Having described the invention in detail and by reference to the preferred embodiment thereof, it will be apparent that other modifications and variations are possible without departing from the scope of the invention defined in the appended claims.

What is claimed is:

1. A label-price tag composite form including two shipping labels and a plurality of price tags associated with each of said shipping labels, comprising:

a pair of shipping labels, each shipping label having a top edge, a bottom edge, and a pair of side edges, said pair of shipping labels each having one side edge abutting, a pair of price tag sheets, each price tag sheet having a top edge, a bottom edge, and a pair of side edges, each price tag sheet secured at its top edge to the bottom edge of an associated shipping label, the width of each price sheet being less than the width of the shipping label associated therewith, a strip of discard material bridging the space between adjacent side edges of said pair of price tag sheets, said pair of price tag sheets being spaced apart such that the non-adjacent side edges thereof are inwardly of the non-abutting side edges of said pair of shipping labels and define peripheral edges of said composite form, a layer of pressure sensitive adhesive on the back side of said shipping labels, said price tag sheets, and said strip of discard material, and a sheet of release material beneath said shipping labels, said price tag sheets, and said strip of discard material.

2. The label-price tag composite form of claim 1, in which said sheet of release material defines score lines extending upward from the bottom edges of said shipping labels and across the backs of said shipping labels, such that when the release material above said score lines is removed, said price tag sheets may be folded under said shipping labels in a tucked position and said shipping labels held in place on a package surface by the exposed adhesive surrounding said price tag sheets.

3. The label-price tag composite form of claim 8, in which said pair of shipping labels define perforation tear lines extending upward from the bottom edges of said shipping labels adjacent the side edges of said price tag sheets and across the fronts of said shipping labels adjacent the top edges of said shipping labels, such that said price tag sheets may be removed from a package surface by tearing along said perforation tear lines.

4. The label-price tag composite form of claim 1, in which said strip of discard material bridging the space between adjacent side edges of said pair of price tag sheets defines a score line about its periphery and in which the sheet of release material defines a score line therebeneath, whereby said strip of discard material and the portion of the sheet of release material therebeneath may be removed after printing on said shipping labels and said price tag sheets.

5. The label-price tag composite form of claim 1, in which each price tag sheet is secured at its top edge to the bottom edge of an associated shipping label along a perforated fold line.

6. The label-price tag composite form of claim 1, in which said pair of price tag sheets each include a plurality of perforation lines which define a plurality of price tag labels.

7. A quantity of label-price tag composite forms, each such composite form including two shipping labels and a plurality of price tags associated with each of said shipping labels, comprising:

a pair of shipping labels, each shipping label having a top edge, a bottom edge, and a pair of side edges, said pair of shipping labels each having one side edge abutting, a pair of price tag sheets, each price tag sheet having a top edge, a bottom edge, and a pair of side edges, each price tag sheet secured at its top edge to the bottom edge of an associated shipping label, the width of each price sheet being less than the width of the shipping label associated therewith, a strip of discard material bridging the space between adjacent side edges of said pair of price tag sheets, said pair of price tag sheets being spaced apart such that the non-adjacent side edges thereof are inwardly of the non-abutting side edges of said pair of shipping labels and define a portion of the periphery of said composite form, a layer of pressure sensitive adhesive on the back side of said shipping labels, said price tag sheets, and said strip of discard material, and a sheet of release material beneath said shipping labels, said price tag sheets, and said strip of discard material.

8. The quantity of label-price tag composite forms of claim 7, in which said sheet of release material defines score lines extending upward from the bottom edges of said shipping labels and across the backs of said shipping labels, such that when the release material above said score lines is removed, said price tag sheets may be folded under said shipping labels in a tucked position and said shipping labels held in place on a package surface by the exposed adhesive surrounding said price tag sheets.

9. The quantity of label-price tag composite forms of claim 8, in which said pair of shipping labels define perforation tear lines extending upward from the bottom edges of said shipping labels adjacent the side edges of said price tag sheets and across the fronts of said shipping labels adjacent the top edges of said shipping labels, such that said price tag sheets may be removed from a package surface by tearing along said perforation tear lines.

10. The quantity of label-price tag composite forms of claim 7, in which said strip of discard material bridging the space between adjacent side edges of said pair of price tag sheets defines a score line about its periphery and in which the sheet of release material defines a score line therebeneath, whereby said strip of discard material and the portion of the sheet of release material therebeneath may be removed after printing on said shipping labels and said price tag sheets.

11. The quantity of label-price tag composite forms of claim 7, in which each price tag sheet is secured at its top edge to the bottom edge of an associated shipping label along a perforated fold line.

12. The quantity of label-price tag composite forms of claim 7, in which said pair of price tag sheets each include a plurality of perforation lines which define a plurality of price tag labels.

* * * * *